US011056858B2

(12) United States Patent
Izumi et al.

(10) Patent No.: US 11,056,858 B2
(45) Date of Patent: Jul. 6, 2021

(54) SPARK PLUG HAVING A HOUSING WITH A CHANNEL PART

(71) Applicant: DENSO CORPORATION, Kariya (JP)

(72) Inventors: Yoshihiro Izumi, Nisshin (JP); Masamichi Shibata, Kariya (JP); Kanechiyo Terada, Kariya (JP); Tetsuya Miwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/931,897

(22) Filed: Jul. 17, 2020

(65) Prior Publication Data

US 2021/0021106 A1 Jan. 21, 2021

(30) Foreign Application Priority Data

Jul. 18, 2019 (JP) ..... JP2019-132574

(51) Int. Cl.
*H01T 13/32* (2006.01)
*F02P 15/00* (2006.01)
*F02P 3/02* (2006.01)

(52) U.S. Cl.
CPC ..... *H01T 13/32* (2013.01); *F02P 15/00* (2013.01); *F02P 3/02* (2013.01)

(58) Field of Classification Search
CPC ..... H01T 13/32; H01T 13/16; H01T 13/34; F02P 15/00; F02P 3/02; F02B 19/12
See application file for complete search history.

(56) References Cited

U.S. PATENT DOCUMENTS

2008/0092838 A1* 4/2008 Takeuchi ..... H01T 13/18 123/169 R
2008/0093965 A1* 4/2008 Takada ..... H01T 13/18 313/143
2010/0101521 A1* 4/2010 Mori ..... H01T 13/16 123/169 R
2015/0192099 A1* 7/2015 Ando ..... H01T 13/20 123/549

FOREIGN PATENT DOCUMENTS

JP 2014-013667 1/2014
JP 2018-181592 11/2018

* cited by examiner

*Primary Examiner* — Tracie Y Green
(74) *Attorney, Agent, or Firm* — Nixon & Vanderhye P.C.

(57) ABSTRACT

A spark plug has a housing of a cylindrical shape and an insulator supported to an inside of the housing. A channel part is formed at a distal end side of the housing. The channel part is open so that the inside of the housing communicates with an outside of the housing through the channel part. The channel part has a channel bottom having a tapered shape oblique relative to a plug central axis. An overall channel bottom is arranged in the housing closer to a proximal end side than to the distal end side of the housing.

10 Claims, 19 Drawing Sheets

COMPARATIVE EXAMPLE

SPARK PLUG HAVING A HOUSING WITH A CHANNEL PART

CROSS-REFERENCE TO RELATED APPLICATION

This application is related to and claims priority from Japanese Patent Application No. 2019-132574 filed on Jul. 18, 2019, the contents of which are hereby incorporated by reference.

TECHNICAL FIELD

The present disclosure relates to spark plugs.

BACKGROUND

There is a known spark plug having a housing, an insulator, a central electrode and a ground electrode. A tapered part is formed in a plug circumferential direction of a housing. A diameter of the tapered part of the housing is reduced inward toward a proximal end side of the spark plug. A pocket is formed between the tapered part of the housing and the insulator. A fuel mixture gas in a combustion chamber of an internal combustion engine is fed into the pocket. This prevents a pre-ignition phenomenon from occurring due to the fuel mixture gas remaining in the pocket.

However, it is necessary to further improve the structure of the pocket formed between the housing and the insulator in the spark plug previously described so as to further suppress occurrence of a pre-ignition phenomenon.

SUMMARY

It is desired for the present disclosure to provide a spark plug having a housing having a cylindrical shape and an insulator supported to an inside of the housing. A channel part is formed at a distal end side of the housing. The channel part is open so that the inside of the housing communicates with an outside of the housing through the channel part. The channel part has a channel bottom formed inward toward a proximal end side of the housing. An overall channel bottom of the channel part is arranged in the housing closer to a proximal end side of the housing than to the distal end side of the housing.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
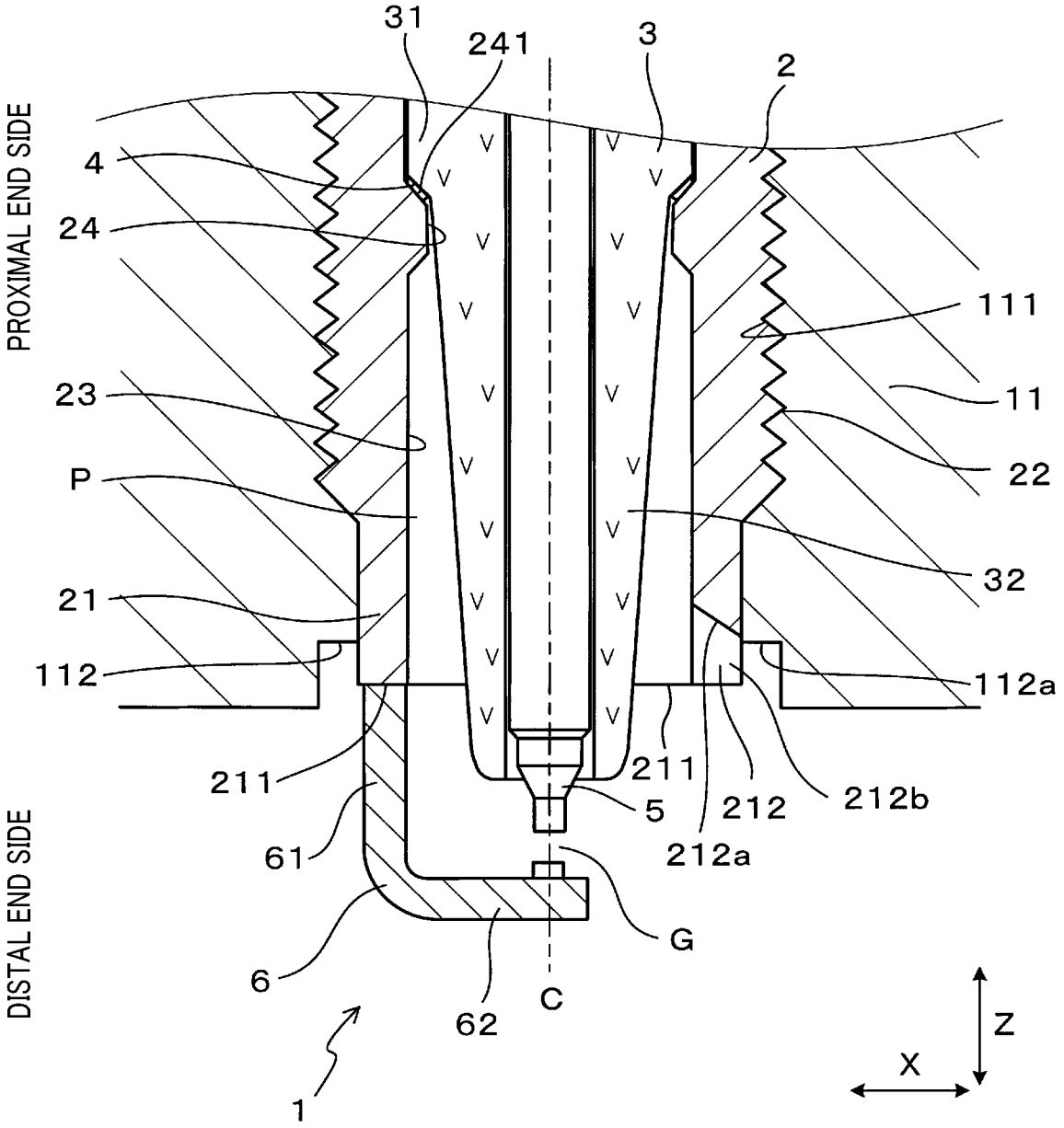
FIG. 1 is a view showing a cross section a region of a distal end side of a spark plug according to a first exemplary embodiment of the present disclosure, mounted on an internal combustion engine.

Hereinafter, various embodiments of the present disclosure will be described with reference to the accompanying drawings. In the following description of the various embodiments, like reference characters or numerals designate like or equivalent component parts throughout the several diagrams.

First Exemplary Embodiment

A description will be given of a spark plug according to a first exemplary embodiment of the present disclosure with reference to FIG. 1 to FIG. 5.

Figure 2:
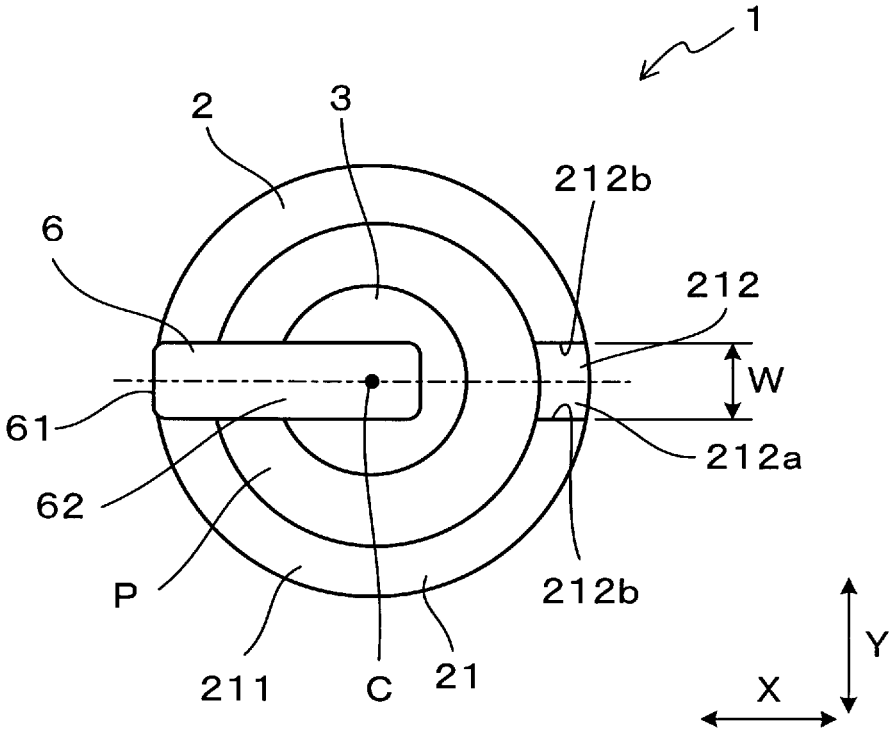
FIG. 2 is a view showing the distal end side of the spark plug according to the first exemplary embodiment shown in FIG. 1 on a cross section of the spark plug orthogonal to the plug axial direction thereof.

FIG. 1 is a view showing a cross section a region of a distal end side of the spark plug 1 according to the first exemplary embodiment of the present disclosure, mounted on an engine head 11 of an internal combustion engine. FIG. 2 is a view showing the distal end side of the spark plug 1 according to the first exemplary embodiment shown in FIG. 1 on a cross section of the spark plug 1 orthogonal to the plug axial direction thereof. As shown in FIG. 1 and FIG. 2, the spark plug 1 according to the first exemplary embodiment has a housing 2 having a cylindrical shape, an insulator 3 supported inside of the housing 2.

The housing 2 has a channel part 212 formed at the distal end side of the housing 2. The channel part 212 is open so that the inside of the housing 2 communicates with the outside of the housing 2 through the channel part 212.

Figure 3:
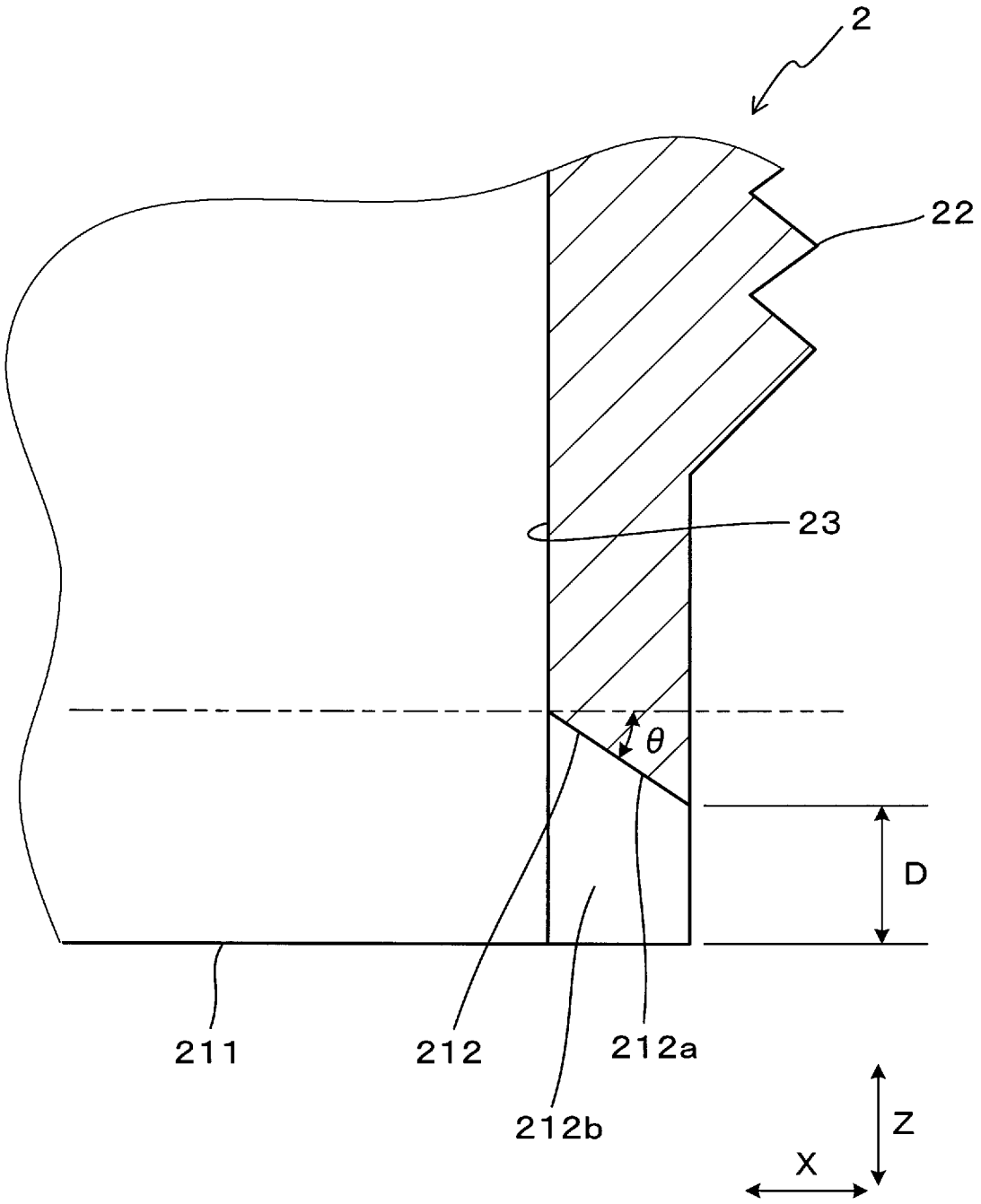
FIG. 3 is a view showing an enlarged cross section a region of a channel part formed in a housing of the spark plug according to the first exemplary embodiment shown in FIG. 1.

FIG. 3 is a view showing an enlarged cross section a region of the channel part 212 formed in the housing 2 of the spark plug 1 according to the first exemplary embodiment shown in FIG. 1.

As shown in FIG. 1 and FIG. 3, a channel bottom 212*a* of the channel part 212 is formed oblique relative to the plug central axis C in the plug axial direction Z. The overall channel bottom 212*a* of the channel part 212 is arranged in the housing 2 closer to the proximal end side of the housing 2 than to a distal end surface 211 of the housing 2 in the plug axial direction Z.

FIG. 2 shows the distal end surface 211 of the housing 2 only, and a projection part of the insulator 3 projected from the distal end side of the housing 2.

A description will now be given of the structure and behavior of the spark plug 1 according to the first exemplary embodiment.

It is possible to apply the spark plug 1 according to the first exemplary embodiment as an ignition means to various types of internal combustion engines such as automobiles, co-generation systems, etc. One terminal of the spark plug 1 is mounted to an ignition coil (not shown), and the other terminal of the spark plug 1 is arranged in the plug axial direction Z to be exposed to an inside of a combustion chamber of an internal combustion engine.

A plug central axis C is arranged along a center of the spark plug 1. The plug central axis C of the spark plug 1 is arranged parallel with the plug axial direction Z. The ignition coil (not shown) is electrically connected to the proximal end side of the spark plug 1 at the upper side in FIG. 1. As shown in FIG. 1, the distal end side of the spark plug 1 is arranged at the bottom side to be exposed to the inside of the combustion chamber (not shown) of an internal combustion engine.

A direction X is orthogonal to the plug axial direction Z. In the direction X, the plug central axis C and a rod-shaped part 61 of the ground electrode 6 are arranged.

A direction Y is orthogonal to the direction X and the plug axial direction Z. The direction X is also orthogonal to the direction Y and the plug axial direction Z.

The peripheral direction of the spark plug 1 will be referred to as the spark plug peripheral direction. The radial direction of the spark plug 1 will be referred to as the plug radial direction.

The housing 2 has a cylindrical shape made of heat-resistant metal material such as iron, nickel, iron-nickel alloy, stainless steel, etc. The housing 2 of the spark plug 1 is mounted on a plug hole formed in an internal combustion engine.

As shown in FIG. 1, a mounting screw part 22 is formed in the outer periphery at the distal end part of the housing 2.

The mounting screw part 22 is mated with a female screw hole 111 formed in the plug hole of an engine head 11 of the internal combustion engine to which the spark plug 1 is mounted.

When the spark plug 1 is mated with the female screw hole 111 of the plug hole of the engine head 11, the spark plug 1 is fixed and mounted to the engine head 11 of the internal combustion engine. In this situation, the central electrode 4 and the ground electrode 5 at the distal end side of the spark plug 1 are exposed to the inside of the combustion chamber of the internal combustion engine.

A head recessed section 112 is formed on the whole circumference at the opening part of the engine head 11 in which the female screw hole 111 is formed. The head recessed section 112 is formed to have a recessed shape toward the proximal end side of the engine head 11, from the outer peripheral side of the distal end side of the engine head 11.

When the spark plug 1 is mounted to the engine head 11 of the internal combustion engine, the distal end side of the spark plug 1 projects from the head recessed section 112 of the engine head 11.

As shown in FIG. 1, a housing front end part 21 is formed to have a cylindrical shape. The inner peripheral surface and the outer peripheral surface of the housing front end part 21 are arranged parallel with the plug axial direction Z.

When the spark plug 1 is mounted to the engine head 11 of the internal combustion engine, a head of the housing front end part 21 is exposed to an inside of a combustion chamber of an internal combustion engine.

As shown in FIG. 1 and FIG. 2, the housing front end part 21 has the channel part 212 which is formed on a part of the overall distal end surface 211 of the housing 2 which is recessed toward the proximal end side of the distal end surface 211 a region of the plug radial direction. The channel part 212 is open to the inner circumferential direction and the outer circumferential direction of the housing front end part 21.

The channel part 212 has the channel bottom 212*a* and a pair of channel side surfaces 212*b*. As shown in FIG. 1 and FIG. 3, the channel bottom 212*a* has a plane shape crossing the plug axial direction Z. That is, as shown in FIG. 1 and FIG. 3, the channel bottom 212*a* is formed oblique relative to the plug central axis C and inward toward the proximal end side of the housing 2. In the structure of the spark plug 1 according to the first exemplary embodiment, the channel bottom 212*a* has a plane shape. In the structure of the spark plug 1 according to the first exemplary embodiment shown in FIG. 3, an angle θ between the channel bottom 212*a* and a virtual plane in the plug axial direction Z is within a range of $37° \leq \theta \leq 58°$.

As shown in FIG. 1, FIG. 2 and FIG. 3, the pair of channel side surfaces 212*b* are formed at both edges of the channel bottom 212*a* in the plug circumferential direction toward the distal end side of the housing 2. As shown in FIG. 2, the pair of channel side surfaces 212*b* is formed parallel with each other and face together in the plug circumferential direction. The distal end of the pair of channel side surfaces 212*b* is connected to the distal end surface 211 of the housing 2, and formed in a direction orthogonal to the plug axial direction Z. The proximal edges of the pair of channel side surfaces 212*b* are formed, oblique relative to the plug central axis C, inward closer to the proximal end side than to the distal end side of the housing 2.

As shown in FIG. 3, in the structure of the spark plug 1 according to the first exemplary embodiment, the depth D at the outer peripheral edge of the channel part 212 in the plug axial direction Z is within a range of $0<D\leq 2.4$ mm. That is, the depth D of the channel part 212 has a length in the plug axial direction Z between the outer peripheral edge of the channel part 212 and the distal end surface 211 of the housing 2.

As shown in FIG. 2, in the structure of the spark plug 1 according to the first exemplary embodiment, the width W of the channel part 212 is within a range of $1.2\text{ mm}\leq W\leq 7.3$ mm. The width W of the channel part 212 is a length of the channel part 212 in a direction orthogonal to a channel formation direction designated by the dash-dotted line (see FIG. 2) in which the channel part 212 is formed. In the spark plug 1 according to the first exemplary embodiment, the channel part 212 has a constant width along the channel formation direction of the channel part 212. When the width of the channel part 212 varies in the channel formation direction, the width W of the channel part 212 indicates the width of the inner circumferential edge of the channel part 212.

As shown in FIG. 2, the channel part 212 is formed in the distal end side of the housing 2 at the location opposite to the rod-shaped part 61 of the ground electrode 6. In the structure of the spark plug 1 according to the first exemplary embodiment, the channel part 212 is formed at the distal end side of the housing 2 opposite to the rod-shaped part 61 of the ground electrode 6 in the direction X. That is, the channel part 212 is arranged separated from the rod-shaped part 61 of the ground electrode 6 by 180° in the plug circumferential direction. The channel part 212, the plug central axis C and the rod-shaped part 61 of the ground electrode 6 are arranged in line in the direction X. In the structure of the spark plug 1 according to the first exemplary embodiment, the channel formation direction, along which the channel part 212 is formed, corresponds to the direction X. The channel formation section corresponds to a direction parallel with the channel side surfaces 212*b* and orthogonal to the plug axial direction Z. In FIG. 2, the straight line extending from the channel formation section is designated by the dash-dotted line.

As shown in FIG. 1, when the spark plug 1 is mounted to the engine head 11, at least a part of the channel part 212 is arranged at a location which projects in the plug axial direction Z from a base surface 112*a* of the head recessed section 112. It is possible to arrange the overall channel part 212 projecting in the plug axial direction Z from the base surface 112*a* of the head recessed section 112. The base surface 112*a* of the head recessed section 112 is formed adjacent to the female screw hole 111 of the engine head 11.

As shown in FIG. 1, a distal end cylindrical surface 23 and the inner circumferential surface of the housing 2 are formed on the inner circumferential surface of the housing 2. The mounting screw part 23 has a cylindrical shape in the plug central axis C. As shown in FIG. 1, the mounting screw part 23 is formed from the distal end side of the inner circumferential surface of the housing 2. The mounting screw part 23 has the same inner diameter along the plug axial direction Z.

A housing stopper section 24 is formed at a position adjacent to the proximal end side of the mounting screw part 23 of the housing 2. A part of the inner peripheral surface of the housing 2, as the housing stopper section 24, projects inwardly from the mounting screw part 23. The housing stopper section 24 is formed at the inner circumferential side of the mounting screw part 22. The housing stopper section 24 is formed on the overall inner circumferential surface of the housing 2 to have a ring shape.

A seat surface 241 located at the proximal end side of the housing stopper section 24 has a tapered shape inward toward the distal end side of the housing 2 in the plug axial direction Z. The seat surface 241 is formed along the overall plug circumferential direction and has a ring shape. The insulator 3 is mated with the seat surface 241 through a packing 4.

The insulator 3 is made of insulation material such as alumina and has a cylindrical shape. The proximal end side and the distal end side of the insulator 3 project from the housing 2. The insulator 3 is supported by the housing stopper section 24 at the location of an insulator stopper section 31.

The outer circumferential surface of the insulator stopper section 31 is formed along the overall plug circumferential direction of the insulator 3 to have a ring shape. That is, the housing stopper section 24 has a ring shape so as to seal the insulator stopper section 31 of a ring shape.

The packing 4 has a ring shape to be arranged between the seat surface 241 and the insulator stopper section 31. The seat surface 241 and the insulator stopper section 31 are sealed together by the packing 4. That is, the overall gap formed between the seat surface 241 and the insulator stopper section 31 is completely sealed by the packing 4.

An insulator leg section 32 is formed projected from the insulator stopper section 31 toward the distal end side of the insulator 3 in the plug axial direction Z.

A diameter of the insulator leg section 32 is reduced toward the distal end side in the plug axial direction Z. The distal end side of the insulator leg section 32 projects from the distal end side of the housing 2. A cross section, orthogonal to the plug axial direction Z, of the outer circumferential surface of the insulator leg section 32 has a circular shape.

A pocket P is formed between the housing 2 and the insulator 3 in the plug diameter direction. In the structure of the housing 2 of the spark plug 1 according to the first exemplary embodiment, the mounting screw part 23 has a constant inner diameter. A diameter of the outer peripheral surface of the insulator leg section 32 of the insulator 3 is reduced toward the distal end side of the insulator 3. Accordingly, the diameter of the pocket P, in the plug diameter direction, formed between the mounting screw part 23 and the insulator leg section 32 is reduced toward the direction to the distal end side of the insulator 3, and a cross sectional area of the pocket, orthogonal to the plug axial direction Z, is reduced.

The central electrode 5 is arranged in the inside of the insulator 3. The central electrode 5 has a cylindrical shape made of a conductive material such as a Ni-based alloy. A metal member having a superior heat conductivity such as CU is arranged in the inside of the central electrode 5. The central electrode 5 is arranged in the area at the distal end side of the insulator 3 and supported by the insulator 3. The tip part of the central electrode 5 projects from the insulator.

The distal end surface 211 of the housing 2 is connected to the ground electrode 6. A discharge gap G (or a spark gap) is formed between the central electrode 5 and the ground electrode 6.

The ground electrode 5 has the rod-shaped part 61 and an extension part 62. The rod-shaped part 61 extends from the distal end surface 211 of the housing 2 in the plug axial direction Z. The extension part 62 is arranged facing the central electrode 5 in the plug axial direction Z, and has a curved shape which is curved from the rod-shaped part 61 inwardly in the plug diameter direction of the spark plug 1. A part of the extension part 62 is arranged facing the distal end surface of the central electrode 5 in the plug axial direction Z. The distal end surface of the central electrode 5 and the ground electrode 6 form the discharge gap G. A fuel mixture gas introduced in the combustion chamber is ignited by the generation of a spark discharge in the discharge gap G.

Figure 4:
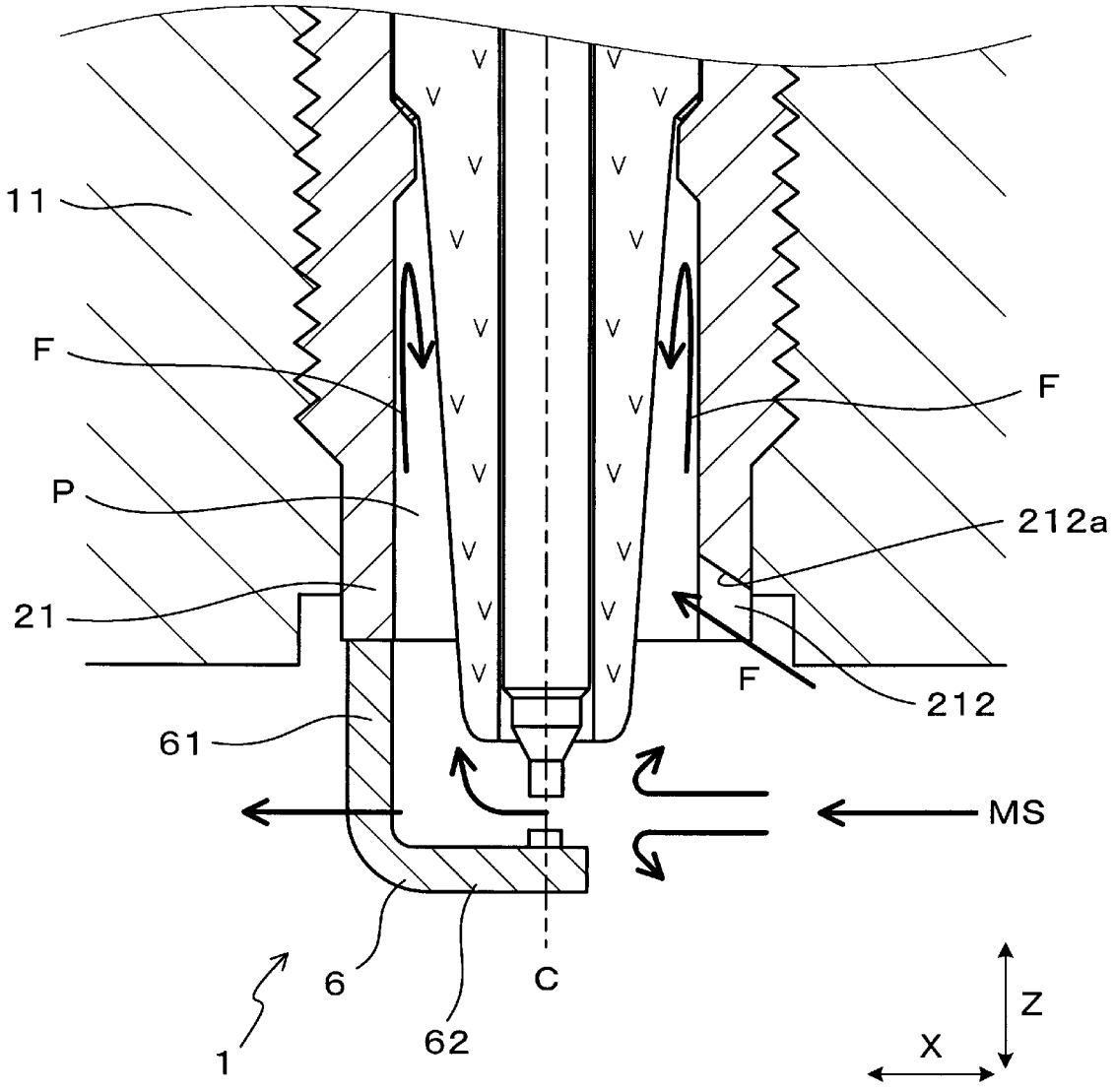
FIG. 4 is a schematic view showing a flow of fuel mixture gas flowing around the spark plug according to the first exemplary embodiment mounted to the internal combustion engine.

FIG. 4 is a schematic view showing a flow of fuel mixture gas flowing around the spark plug 1 according to the first exemplary embodiment mounted to the internal combustion engine. As shown in FIG. 4, the spark plug 1 is mounted to an internal combustion engine at a position so that a downstream side of the fuel mixture gas MS is arranged at the location of the rod-shaped part 61 of the ground electrode 6 when the internal combustion engine starts and the fuel mixture gas MS flows around the distal end side of the spark plug 1.

It is known that the main stream of the fuel mixture gas MS collides with the rod-shaped part 61 of the ground electrode 6, and the main stream of the fuel mixture gas MS is easily guided into the pocket P when the spark plug 1 is mounted to the internal combustion engine at this position previously described.

Further, it is known that this arrangement of the spark plug 1 in the internal combustion engine previously described makes it possible to easily remain the fuel mixture gas MS in the pocket P. This arrangement often causes a pre-ignition phenomenon in the pocket P.

In order to avoid this drawback, the spark plug 1 according to the first exemplary embodiment has the improved structure in which the channel part 212 is formed at the distal end side of the housing 2 even if the spark plug 1 is mounted to an internal combustion engine at a bad position to easily cause a pre-ignition phenomenon. The formation of the channel part 212 in the housing front end part 21 makes it possible to promote discharging of the fuel mixture gas MS from the pocket P, and to suppress such a pre-ignition phenomenon in the pocket P from occurring.

When the spark plug 1 is mounted to an internal combustion engine, it is possible to align the flowing direction of the fuel mixture gas MS in the direction along which an intake valve and an exhaust valve of an internal combustion engine are arranged. It is possible to adjust the plug circumferential direction of the spark plug 1 mounted to an internal combustion engine by varying the formation position of the mounting screw part 22 in the housing 2. Further, it is acceptable to adjust the mount position of the spark plug 1 mated with the engine head 11 of the internal combustion engine by arranging a spacer or a gasket sandwiched between the engine head 11 and the housing 2 at the proximal end side of the mounting screw part 22.

A description will now be given of the behavior and effects of the spark plug 1 according to the first exemplary embodiment.

The spark plug 1 according to the first exemplary embodiment has the improved structure in which the channel bottom 212*a* of the channel part 212 has a slope shape oblique relative to the plug central axis C and inward closer to the proximal end side than to the distal end side of the housing 2 in the plug axial direction Z shown in FIG. 1 and FIG. 3. This improved structure makes it possible for the channel part 212 to guide the flow of the fuel mixture gas toward the pocket Pin the combustion chamber of an internal combustion engine, to which the spark plug 1 according to the first exemplary embodiment has been mounted. This makes it possible to avoid the fuel mixture gas from staying and to promote the fuel mixture gas from being discharged from the pocket P. This improved structure makes it possible to easily discharge the fuel mixture gas from the pocket P.

Figure 5:
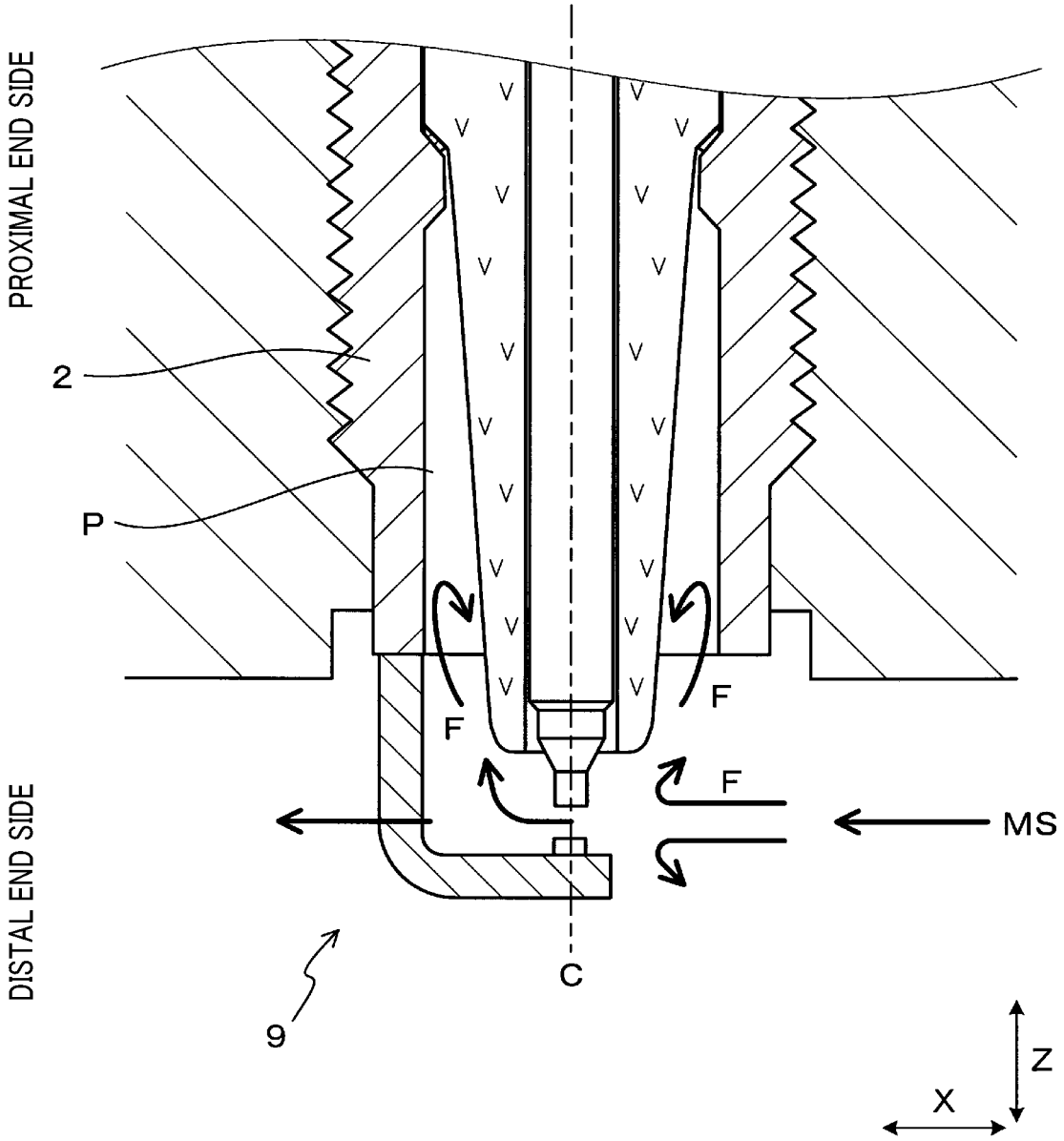
FIG. 5 is a view showing a cross section of a spark plug as a comparative example, mounted on an internal combustion engine, and showing an explanation of a flow direction of a fuel mixture gas around the spark plug.
Figure 9:
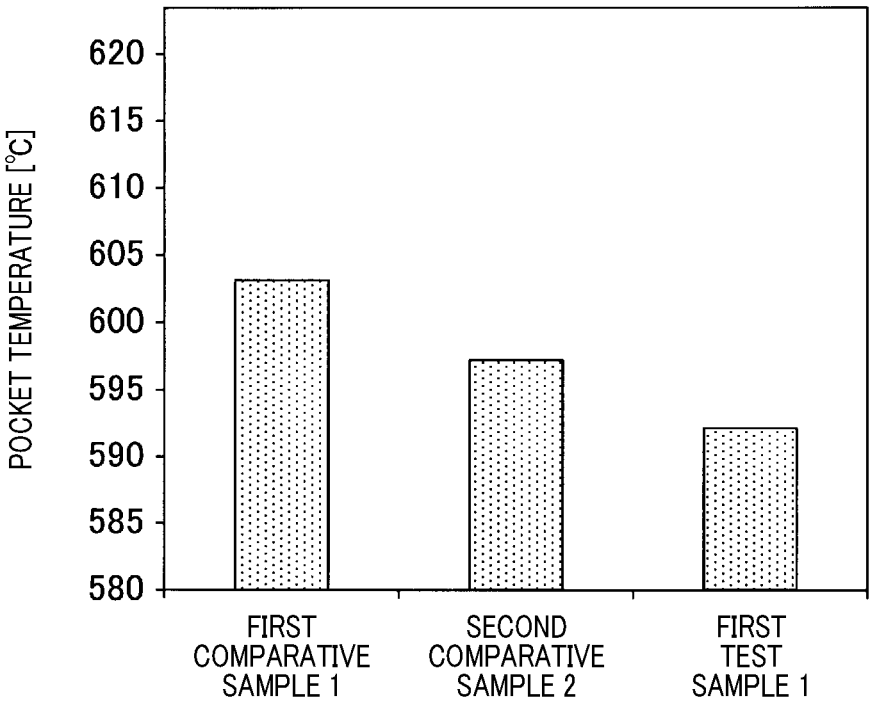
FIG. 9 is a graph showing analysis results of a first experiment, i.e. showing a pocket temperature as an average temperature at a measurement point A in a pocket P of each of a first test sample, a first comparative sample, and a second comparative sample.

FIG. 5 is a view showing a cross section of a spark plug 9 as a comparative example mounted on an internal combustion engine. FIG. 9 shows an explanation of a flow direction of a fuel mixture gas flowing around the spark plug 9. The housing of the spark plug 9 shown in FIG. 5 has no channel part. On the other hand, the spark plug 1 according to the first exemplary embodiment has the channel part 212 shown in FIG. 1 to FIG. 4.

In the structure of the spark plug 9 as the comparative example, a diameter of the pocket P in the plug axial direction Z is gradually reduced toward the proximal end side of the spark plug 9. That is, a cross sectional area of the pocket P, orthogonal to the plug axial direction Z, is reduced toward the proximal end side of the spark plug 9.

Under the situation in which the spark plug 9 as a comparative example is mounted to an internal combustion engine, when the main stream MS of the fuel mixture gas is passing to the distal end side of the spark plug 9, the main stream MS of the fuel mixture gas collides with the distal end of the spark plug 9. The fuel mixture gas is curved and a part of the fuel mixture gas is introduced into the inside of the pocket P due to this collision of the fuel mixture gas with the front end of the spark plug 9.

As previously described, because the dimension of the diameter of the cross section of the pocket P, orthogonal to the plug axial direction Z, is reduced toward the proximal end direction of the spark plug 1, i.e. deeper into the pocket P, it is difficult for the flow F of the fuel mixture gas introduced into the inside of the pocket P to reach the innermost area of the pocket P. Accordingly, it is difficult for the fuel mixture gas at the opening area of the pocket P to have its required flow speed. That is, in the structure of the pocket P in the spark plug 9 according to the comparative example, the flow F of the fuel mixture gas is easily stayed in the inside of the pocket P.

On the other hand, the spark plug 1 according to the first exemplary embodiment shown in FIG. 4 has the channel part 212. This improved structure makes it possible to guide, along the channel part 212, a part of the main stream MS of the fuel mixture gas passing to the distal end side of the spark plug 1. The part of the main stream MS of the fuel mixture gas is guided deeper into the pocket P. This makes it possible for the fuel mixture gas to easily reach the deep part of the pocket P at a necessary flow speed in the overall inside area of the pocket P.

The overall channel bottom 212*a* of the channel part 212 is arranged closer to the proximal end side of the housing 2 than to the distal end surface 211 side of the housing 2 in the plug axial direction Z. This structure makes it possible to easily guide the flow of the fuel mixture gas deeper into the pocket P formed between the housing 2 and the insulator 3. This makes it possible to easily discharge the fuel mixture gas from the pocket P, and to suppress a pre-ignition phenomenon from occurring in the pocket P. Experimental results and this advantage provided by the improved structure of the spark plug 1 according to the first exemplary embodiment will be explained later in detail.

Further, the spark plug 1 according to the first exemplary embodiment has the structure in which the width W of the channel part 212, in a direction orthogonal to the plug axial direction Z of the spark plug, is within a range of 1.2 mm≤W≤7.3 mm. The improved structure makes it possible to suppress an inside temperature of the pocket P from increasing on the basis of the experiment results which will be explained later.

Still further, the spark plug 1 according to the first exemplary embodiment has the structure in which the depth D at the outer peripheral edge of the channel part 212 is within a range of 0 mm<D≤2.4 mm. The improved structure makes it also possible to suppress an inside temperature of the pocket P from increasing on the basis of the experiment results which will be explained later.

In the structure of the spark plug 1 according to the first exemplary embodiment previously described, the channel bottom 212*a* has a plane shape, and the angle θ between the channel bottom 212*a* and a virtual plane orthogonal to the plug axial direction Z is within a range of 37°≤θ58°. This structure makes it possible to guide the flow of the fuel mixture gas into deeper into the pocket P. Because this angle θ is not less than 58° (θ≤58°), this improved structure makes it possible to easily guide the flow of the fuel mixture gas into deeper into the pocket P, and to provide a necessary flow speed of the fuel mixture gas in the pocket P. Still further, this structure makes it possible to suppress the inside temperature of the pocket P from increasing. The experimental results described later support these advantages of the spark plug 1. The experimental results will be explained later in detail.

The overall channel part 212 is formed in the housing 2 at the location opposite to the rod-shaped part 61 of the ground electrode 6. This arrangement allows a fuel mixture gas to be introduced into the inside of the pocket P and to promote discharging of the fuel mixture gas from the pocket P even if the spark plug 1 is mounted to the engine head 11 in the situation to easily cause a pre-ignition phenomenon in the pocket P.

When the rod-shaped part 61 of the ground electrode 6 in the spark plug 1 is arranged at the downstream side of the main stream MS of the fuel mixture gas flowing around the distal end side of the spark plug 1 mounted to the engine head 11, a pre-ignition phenomenon relatively occurs relatively easily. However, even if the spark plug 1 is mounted to the engine head 11 at the position previously described, when the overall channel part 212 is arranged at the location opposite to the rod-shaped part 61 side, the channel part 212 is located at the upstream side of the main stream MS of the fuel mixture gas in the spark plug 1.

It is possible for the main stream MS of the fuel mixture gas to be guided from the upstream side into the inside of the pocket P through the channel part 212 by the improved structure of the spark plug 1 and this arrangement of the spark plug 1 previously described. This structure and arrangement of the spark plug 1 make it possible to promote the fuel mixture gas stayed in the pocket P gas from being discharged. This makes it possible to prevent an inside temperature of the pocket P from increasing, and to prevent a pre-ignition phenomenon from occurring in the pocket P.

As previously described, the first exemplary embodiment provides the spark plug 1 having the improved structure capable of suppressing occurrence of a pre-ignition phenomenon.

First Experiment

A description will be given of the first experimental results with reference to FIG. 6 to FIG. 9.

The first experiment used a first test sample 1, a first comparative sample 91 and a second comparative sample 92. The first test sample 1 had the same structure of the spark plug 1 according to the first exemplary embodiment. The first experiment performed a temperature simulation of each of the first test sample 1, the first comparative sample 91 and the second comparative sample 92. The same components between the spark plug 1 according to the first exemplary embodiment and the first comparative sample 91 and the second comparative sample 92 will be referred to with the same reference numbers and characters.

Each of the first comparative sample 91 and the second comparative sample 92 has the same basic structure of the first test sample 1. No channel part was formed in each of the first comparative sample 91 and the second comparative sample 92. On the other hand, the channel part 212 having the structure shown in FIG. 1 to FIG. 4 was formed in the first test sample 1.

Figure 6:
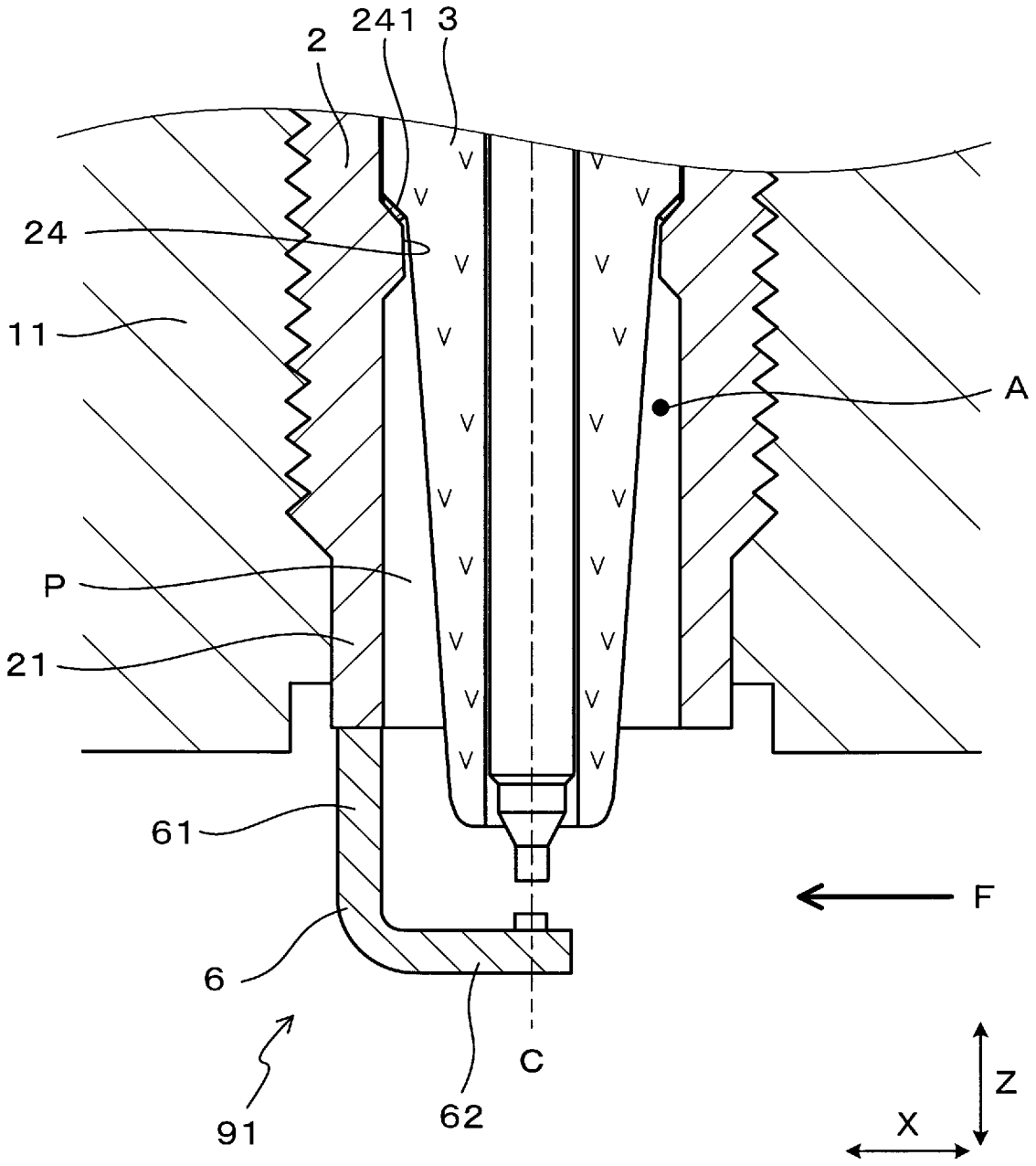
FIG. 6 is a view showing a cross section of a first comparative sample used by a first experiment, mounted on the internal combustion engine.

FIG. 6 is a view showing a cross section of the first comparative sample 91 used by the first experiment, mounted on the internal combustion engine. As shown in FIG. 6, the first comparative sample 91 has the distal end part 21 having a cylindrical shape.

Figure 7:
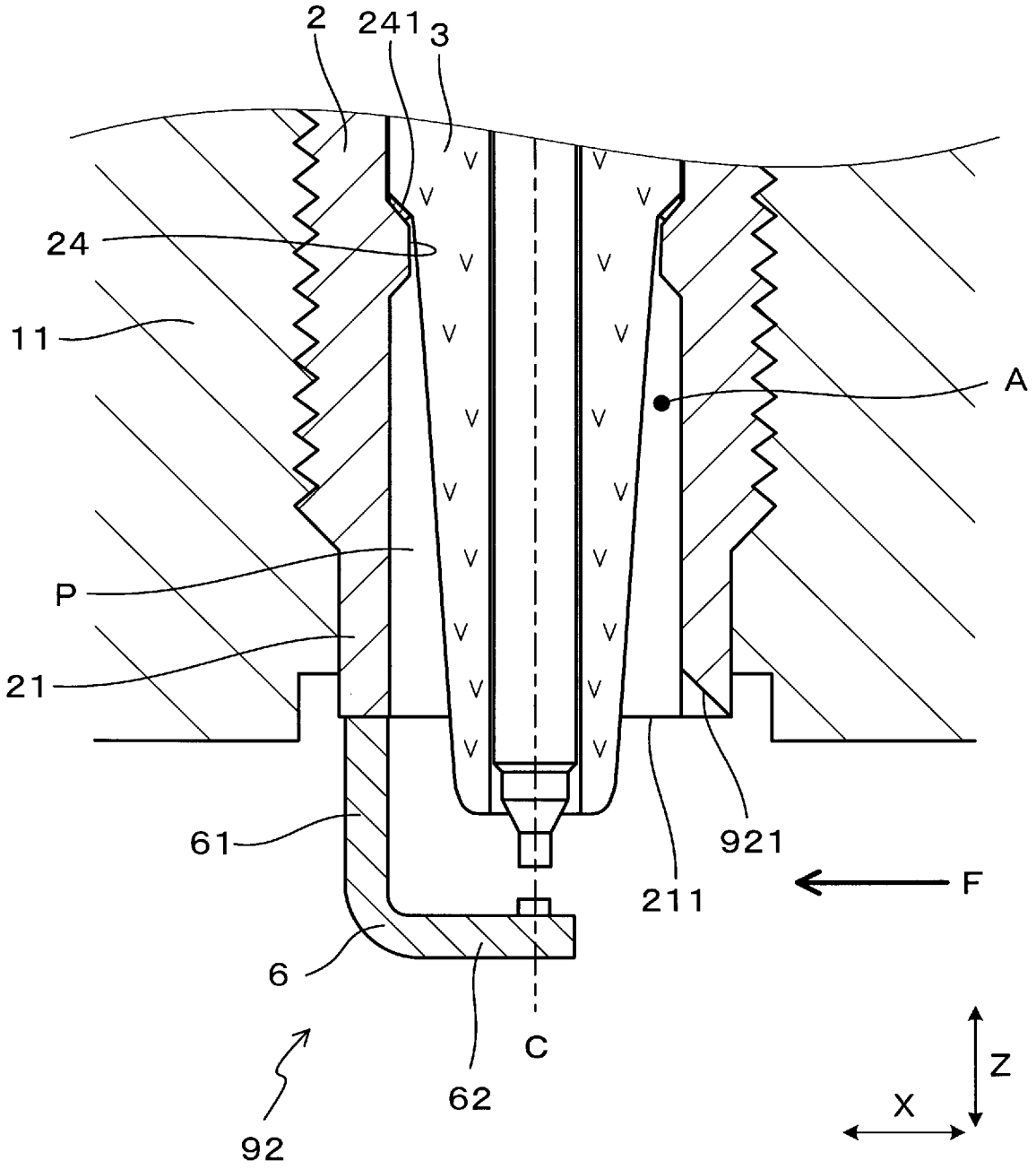
FIG. 7 is a view showing a cross section of a second comparative sample used by the first experiment, mounted on the internal combustion engine.

FIG. 7 is a view showing a cross section of the second comparative sample 92 used by the first experiment, mounted on the internal combustion engine. As shown in FIG. 7, a receding surface 921 was formed at the distal end part 21 of the housing in the second comparative sample 92.

The receding surface 921 had a plane shape to be formed oblique relative to the plug central axis C and inward closer to the proximal end side than to the distal end side of the housing 2. The outer peripheral surface of the receding surface 921 was formed at the same position of the distal end side 211 of the housing 2 along the plug axial direction Z. That is, the overall receding surface 921 is not formed in the distal end section. In the structure of the second comparative sample 92 shown in FIG. 7, one side of the receding surface 921 was formed at the distal end surface 211 of the housing 2.

This structure of the receding surface 921 formed in the housing of the second comparative sample 92 was different from that of the channel part 212 formed in the housing 2 in the spark plug 1 according to the first exemplary embodiment. Other components of the second comparative sample 92 were the same as those of the first test sample 1 as the spark plug 1 according to the first exemplary embodiment.

Figure 8:
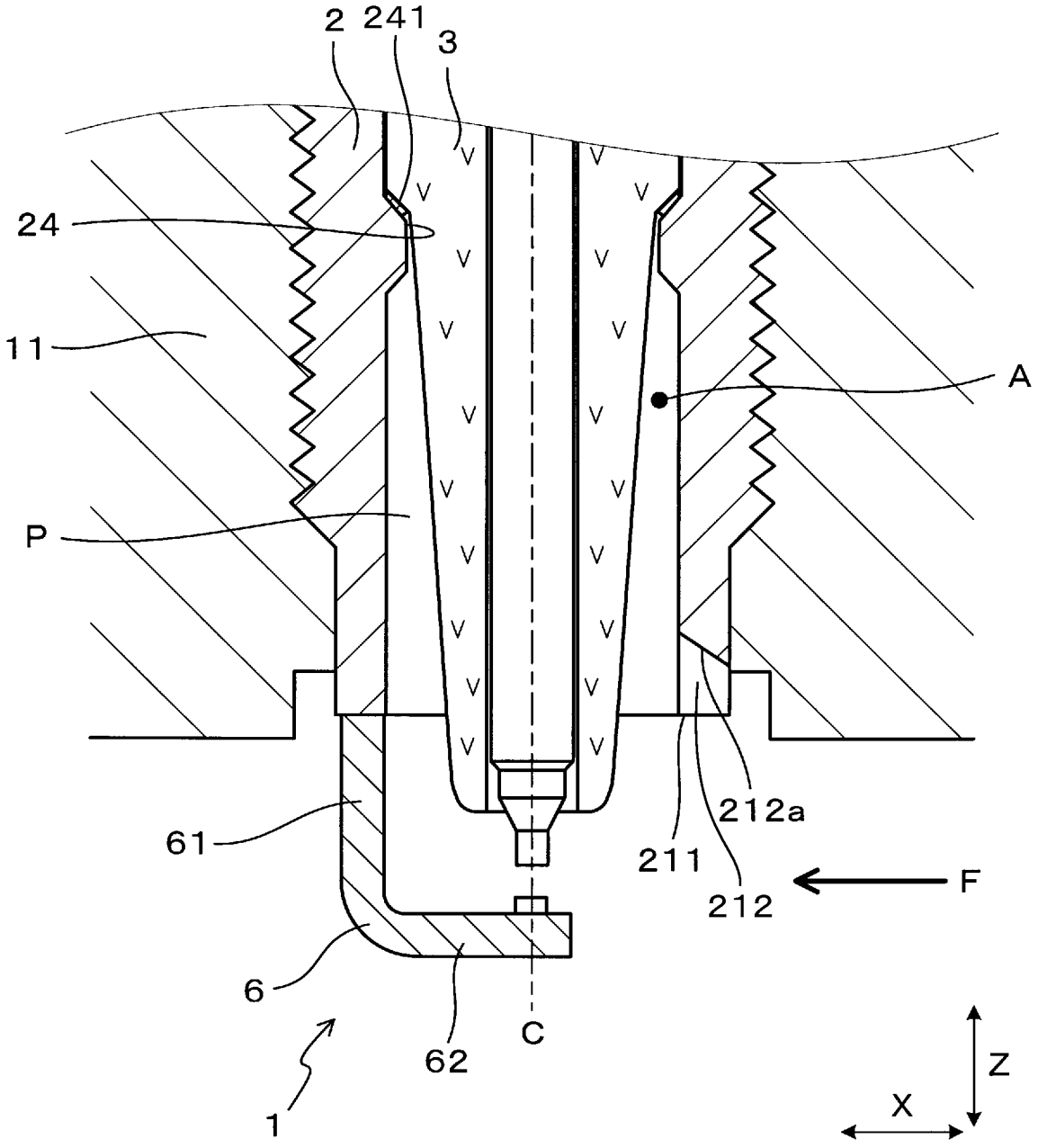
FIG. 8 is a view showing a cross section of the first test sample used by the first experiment, mounted on the internal combustion engine.

FIG. 8 is a view showing a cross section of the first test sample 1 used by the first experiment, mounted on the internal combustion engine. As shown in FIG. 8, the first test sample 1 had the same structure of the spark plug 1 having the channel part 212 according to the first exemplary embodiment.

The first experiment operated the internal combustion engine, in which each of the first test sample 1, the first comparative sample 91 and the second comparative sample 92 was mounted to the engine head 11, at a rotation speed of 4400 r/min., with a rotation torque of 400 N·m, and an air/fuel ratio (A/F) of 12.7.

The first experiment detected predetermined times a temperature at a measurement point A in the pocket P in each sample when each sample was arranged so that the rod-shaped part 61 of the ground electrode 6 was arranged at the downstream side of a flow F of the fuel mixture gas. The first experiment calculated an average temperature at the point A inside of the pocket P in each sample based on the detected temperature values of each sample.

As shown in FIG. 6, FIG. 7 and FIG. 8, the first experiment used the measurement point A which was located in the pocket P separated from the rod-shaped part 61 of the ground electrode 6 by 180°. That is, the measurement point A was located at the distal end side of the housing stopper section 24 formed at the position adjacent to the proximal end side of the mounting screw part 23 of the housing 2. The measurement point A was located at the point separated by 9 mm from the distal end side of the seat surface 241 located at the proximal end side of the housing stopper section 24.

FIG. 9 is a graph showing analysis results of the first experiment, i.e. showing a pocket temperature as the average temperature at the measurement point A in the pocket P of each of the first comparative sample 91, the second comparative sample 92 and the first test sample 1.

The first experiment calculated the average temperature of the measurement point A of each sample within a range of BTDC 50° to BTDC 30°, where BTDC indicates Before Top Dead Center of a valve timing as a precise timing of the opening and closing of valves in a piston (omitted from drawings) of an internal combustion engine. FIG. 9 shows the analysis results of the first experiment. That is, the calculated average temperature at the measurement point A in each sample is designated as the pocket temperature shown in FIG. 9.

As can be clearly understood from the analysis results shown in FIG. 9, it is recognized that the first test sample 1 has the pocket temperature as an average temperature at the measurement point A which is lower than that of each of the first comparative sample 91 and the second comparative sample 92. These experimental results make it possible to clearly recognize that the channel formation direction of the channel part 212 in the housing 2 can improve discharging of the fuel mixture gas from the inside of the pocket P and reduce the inside temperature of the pocket P. The first test sample 1 has a superior gas-discharging function and a pocket temperature reduction capability.

When the first comparative sample 91 is compared in experimental results with the second comparative sample 92, it is recognized that the first comparative sample 91 has the pocket temperature as an average temperature at the measurement point A which is lower than that of the second comparative sample 92.

Accordingly, because the overall channel part 212 is formed in the distal end section of the housing 2 in the first test sample 1, not formed at the distal end surface 211 of the housing 2 like the receding surface 921 in the second comparative sample 92 (see FIG. 7), this structure of the first test sample 1 improves the discharging function of the fuel mixture gas from the inside of the pocket P, and reduces the inside temperature of the pocket P, as compared with the structure of the second comparative sample 92 in which the receding surface 921 is formed at the distal end surface 211.

(Second Experiment)

A description will be given of the second experimental results with reference to FIG. 10.

Figure 10:
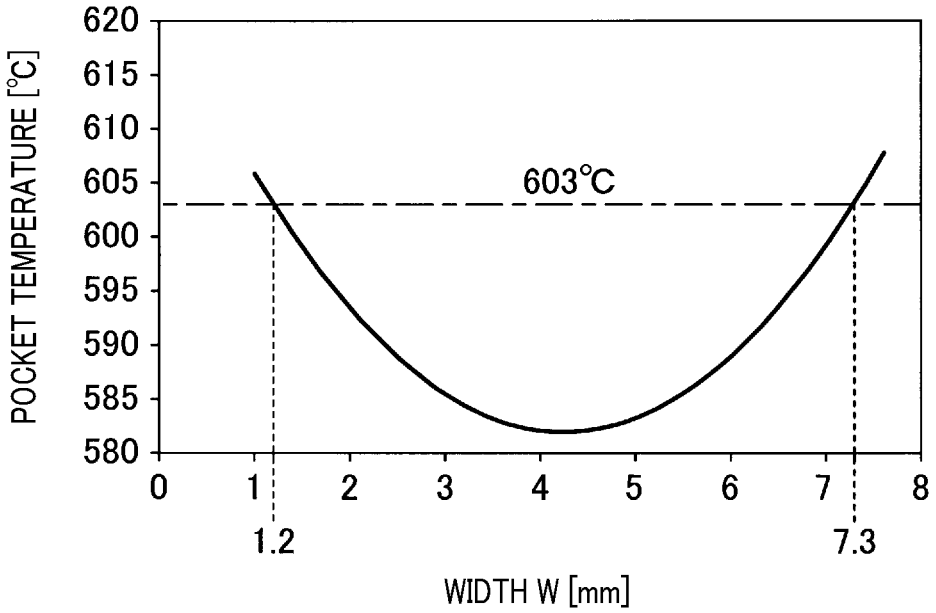
FIG. 10 is a graph showing analysis results of a second experiment, i.e. showing a relationship between a width W of a channel part and the pocket temperature in each of test sample.

FIG. 10 is a graph showing analysis results of the second experiment. FIG. 10 shows a relationship between a width W of the channel part 212 and the pocket temperature in each test sample.

As shown in FIG. 10, the second experiment performed the temperature simulation of each test sample having a different width W of the channel part. Similar to the first experiment, the same components between the first exemplary embodiment, the first and second experiments will be referred to with the same reference numbers and characters.

The second experiment used the test samples having a different width W and the same width W and the same angle θ. Other temperature conditions of the second experiment are the same as the first experiment.

The first and second experiments performed the simulations under the same experimental conditions. FIG. 10 shows the experimental results as the analysis results of the second experiment.

From the experimental results shown in FIG. 10, it can be understood that the pocket temperature can be maintained at not more than a predetermined temperature of 603° C. when the test sample satisfies the width W of the channel part 212 within a range of 11.2 mm≤W≤7.3 mm. In particular, the pocket temperature can be more maintained at not more than 590° C. when the test sample satisfies the width D of the channel part 212 within a range of 4 mm≤W≤5 mm.

(Third Experiment)

A description will be given of the third experimental results with reference to FIG. 11.

Figure 11:
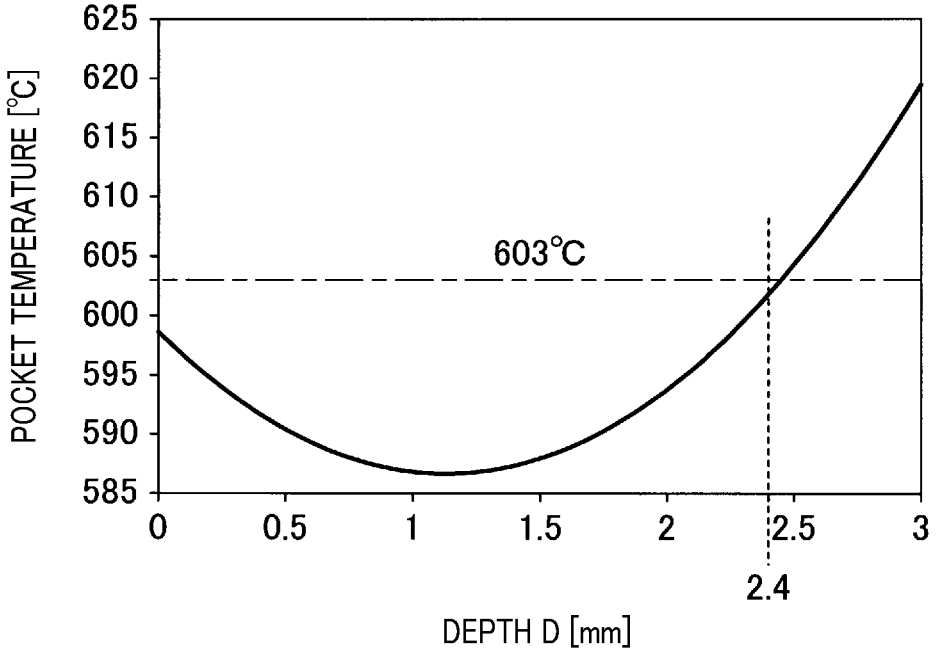
FIG. 11 is a graph showing analysis results of a third experiment, i.e. showing a relationship between a depth D of the channel part and the pocket temperature in each test sample.

FIG. 11 is a graph showing the analysis results of a third experiment. FIG. 11 shows a relationship between a depth D of the channel part 212 and the pocket temperature in the test samples. Similar to the first and second experiments, the same components between the first exemplary embodiment, the first to third experiments will be referred to with the same reference numbers and characters.

The third experiment used the test samples having a different depth D and the same width W and the same angle θ. Other temperature conditions of the third experiment are the same as the first and second experiments.

The first to third experiments performed the simulations under the same experimental conditions. FIG. 11 shows the experimental results as the analysis results of the third experiment.

From the experimental results shown in FIG. 11, it can be understood that the pocket temperature can be maintained at not more than the predetermined temperature of 603° C. when the test sample satisfies the depth D of the channel part 212 within a range of 0.0 mm≤W≤2.4 mm. In particular, the pocket temperature can be more maintained at not more than 590° C. when the test sample satisfies the depth D of the channel part 212 within a range of 0.5 mm≤D≤1.5 mm.

(Fourth Experiment)

A description will be given of the fourth experimental results with reference to FIG. 12.

Figure 12:
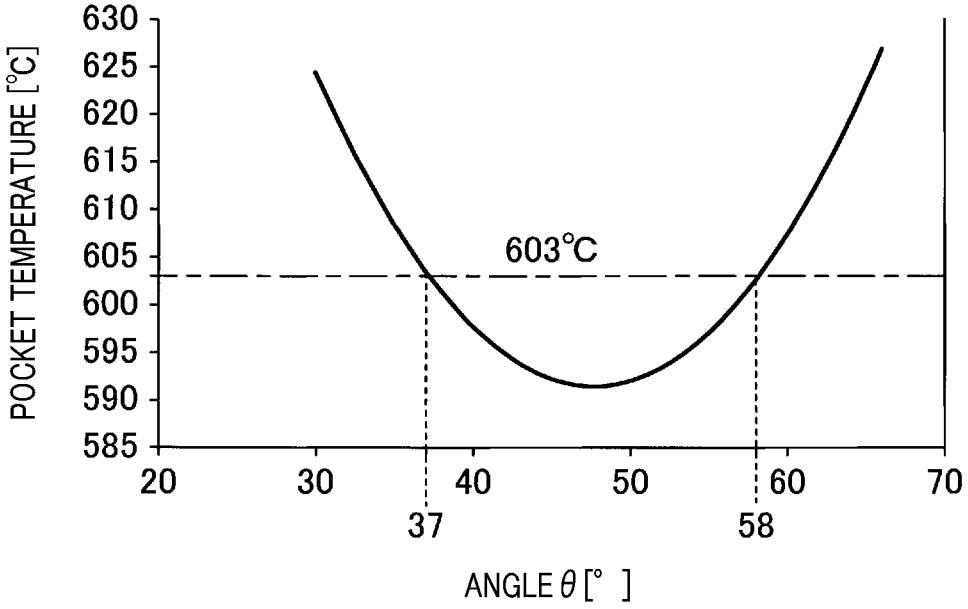
FIG. 12 is a graph showing analysis results of a fourth experiment, i.e. showing a relationship between an angle θ of the channel part and the pocket temperature in each of the first test sample, the first comparative sample, the second comparative sample.

FIG. 12 is a graph showing the analysis results of the fourth experiment. FIG. 12 shows a relationship between an angle θ of the channel part 212 and the pocket temperature in the test samples. Similar to the first to third experiments, the same components between the first exemplary embodiment, the first to fourth experiments will be referred to with the same reference numbers and characters.

The fourth experiment used the test samples having a different angle θ of the channel part 212, and the same width W and the same depth D. Other temperature conditions of the fourth experiment are the same as the first to third experiments. The first to fourth experiments performed the simulations under the same experimental conditions. FIG. 12 shows the experimental results as the analysis results of the fourth experiment.

From the experimental results shown in FIG. 12, it can be understood that the pocket temperature can be maintained at not more than the predetermined temperature of 603° C. when the test sample satisfies the angle θ of the channel part 212 within a range of 37°≤θ≤58°.

Second Exemplary Embodiment

A description will be given of a spark plug according to a second exemplary embodiment of the present disclosure with reference to FIG. 13 to FIG. 15.

Figure 13:
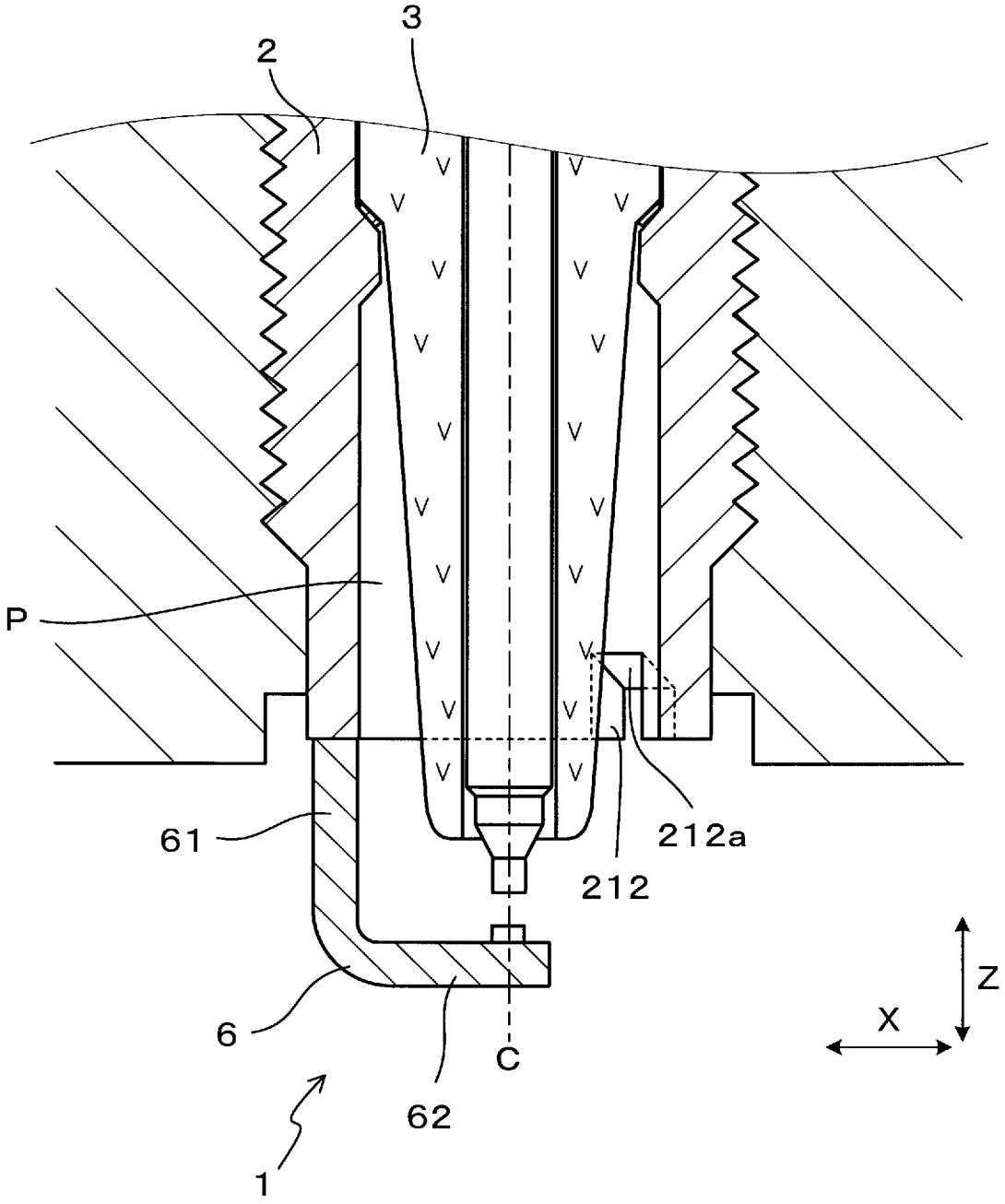
FIG. 13 is a view showing a cross section a region of a distal end side of a spark plug according to a second exemplary embodiment of the present disclosure, mounted on the internal combustion engine.
Figure 14:
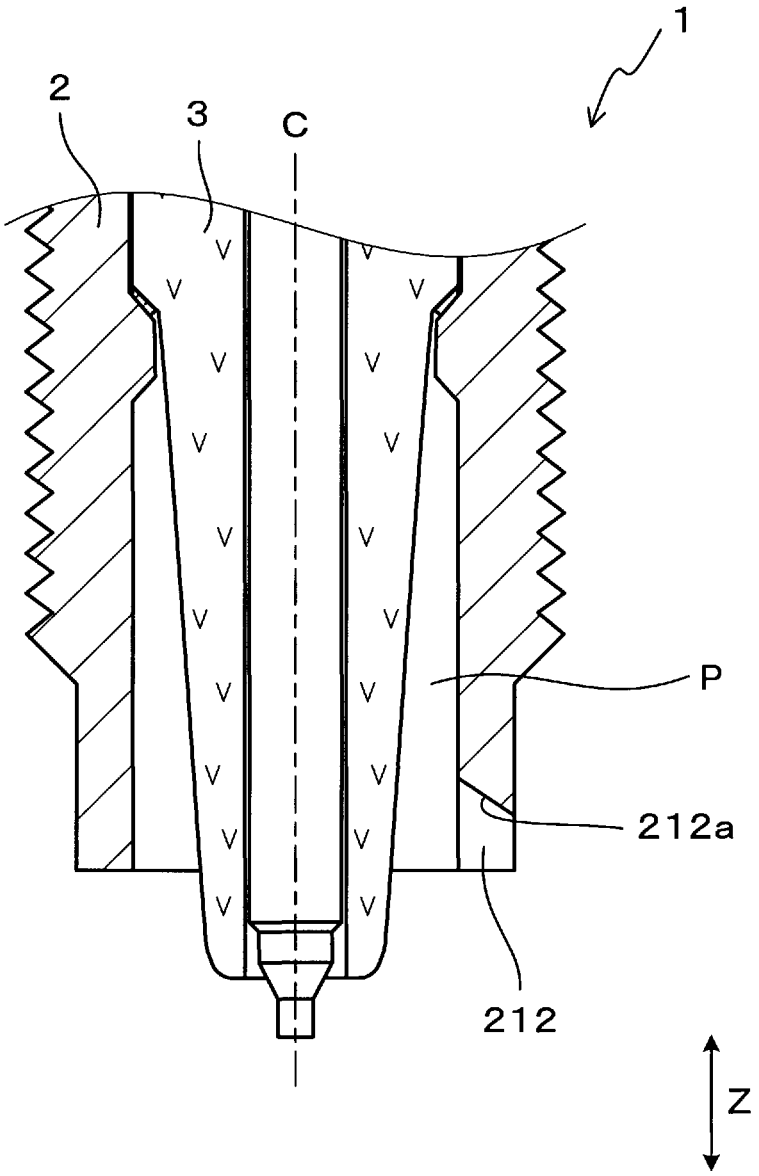
FIG. 14 is a view showing a cross section, passing through the plug central axis, of the channel part of the spark plug according to the second exemplary embodiment.

The spark plug 1 according to the second exemplary embodiment shown in FIG. 13 has the channel part 212 which is formed at a different position from the channel part 212 in the housing 2 of the spark plug 1 according to the first exemplary embodiment shown in FIG. 1.

FIG. 13 is a view showing a cross section a region of the distal end side of the spark plug 1 according to the second exemplary embodiment of the present disclosure. The spark plug 1 is mounted on the internal combustion engine. FIG. 14 is a view showing a cross section, passing through the plug central axis C, of the channel part 212 formed in the housing 2 in the spark plug 1 according to the second exemplary embodiment. FIG. 15 is a view showing the distal end side of the spark plug 1 according to the second exemplary embodiment, on a cross section of the spark plug 1 orthogonal to the plug axial direction thereof.

Figure 15:
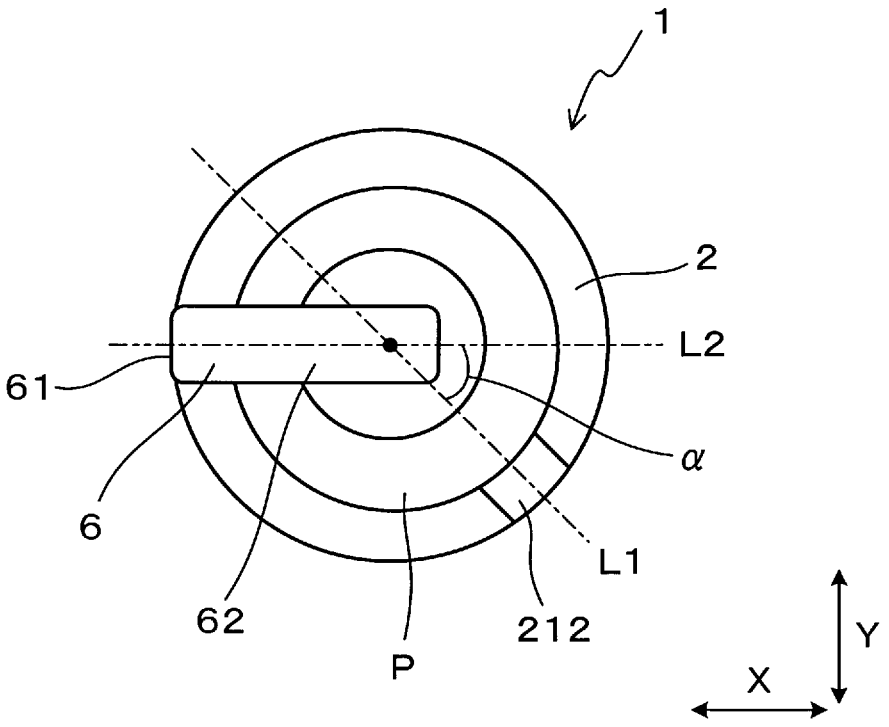
FIG. 15 is a view showing the distal end side of the spark plug according to the second exemplary embodiment on a cross section of the spark plug orthogonal to the plug axial direction thereof.

As shown in FIG. 15, the channel part 212 is formed at a location separated in the plug circumferential direction from the rod-shaped part 61 of the ground electrode 6 approximately by 135°. In the structure of the spark plug according to the second exemplary embodiment, an angle α shown in FIG. 15 formed between a straight line L1 (or a channel formation direction L2) and a straight line L2 is approximately 45°, where the straight line L1 extends in the formation direction of the channel part 212 through the plug central axis C, and the straight line L2 extends from the rod-shaped part 61 through the plug central axis C. Other components of the spark plug according to the second exemplary embodiment are the same as those of the first exemplary embodiment.

The spark plug 1 according to the second exemplary embodiment has the same behavior and effects of the spark plug according to the first exemplary embodiment.

Third Exemplary Embodiment

Figure 17:
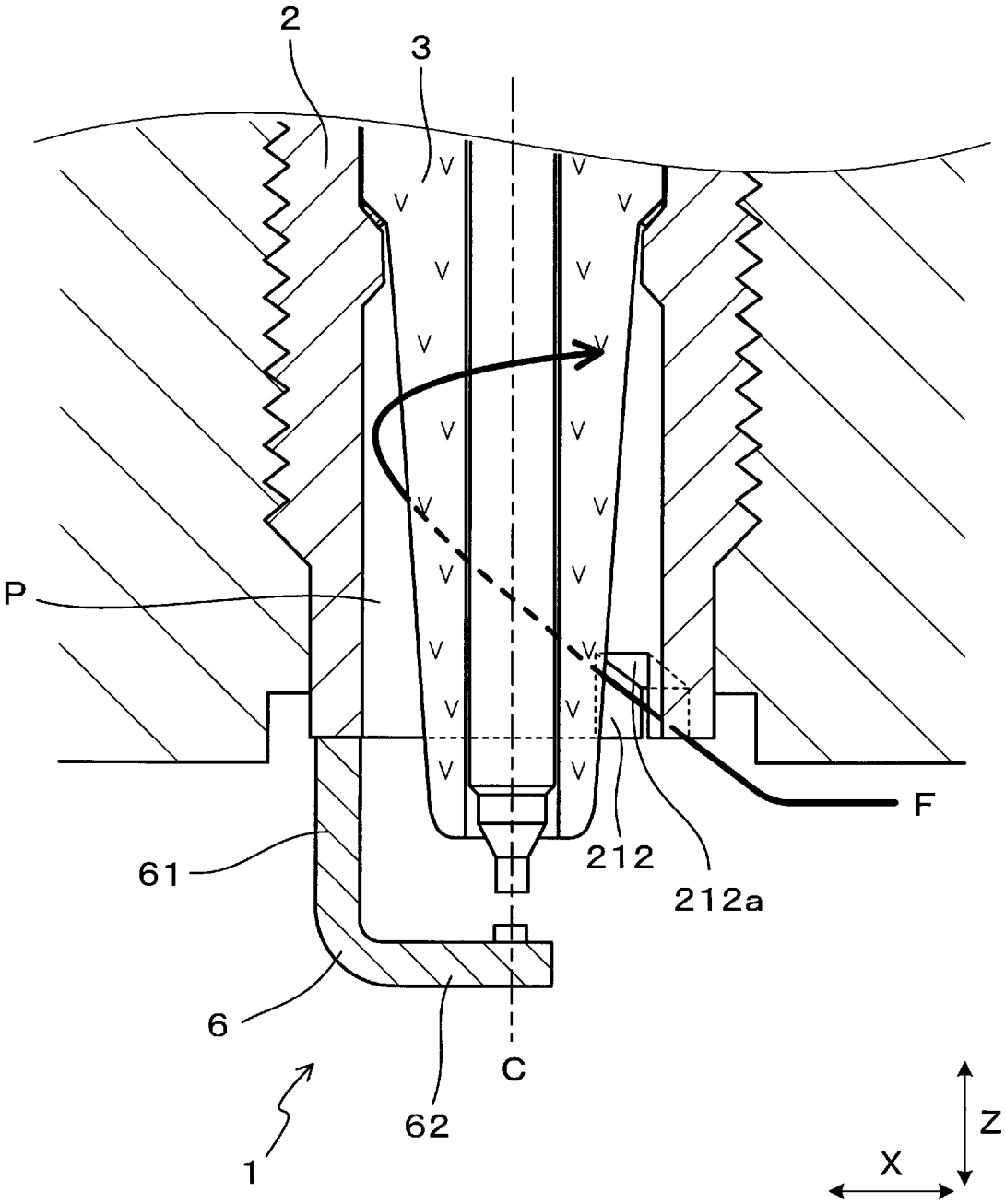
FIG. 17 is a view showing a cross section of the spark plug mounted on the internal combustion engine, and explaining a flow direction of fuel mixture gas in the pocket formed in the spark plug.
Figure 18:
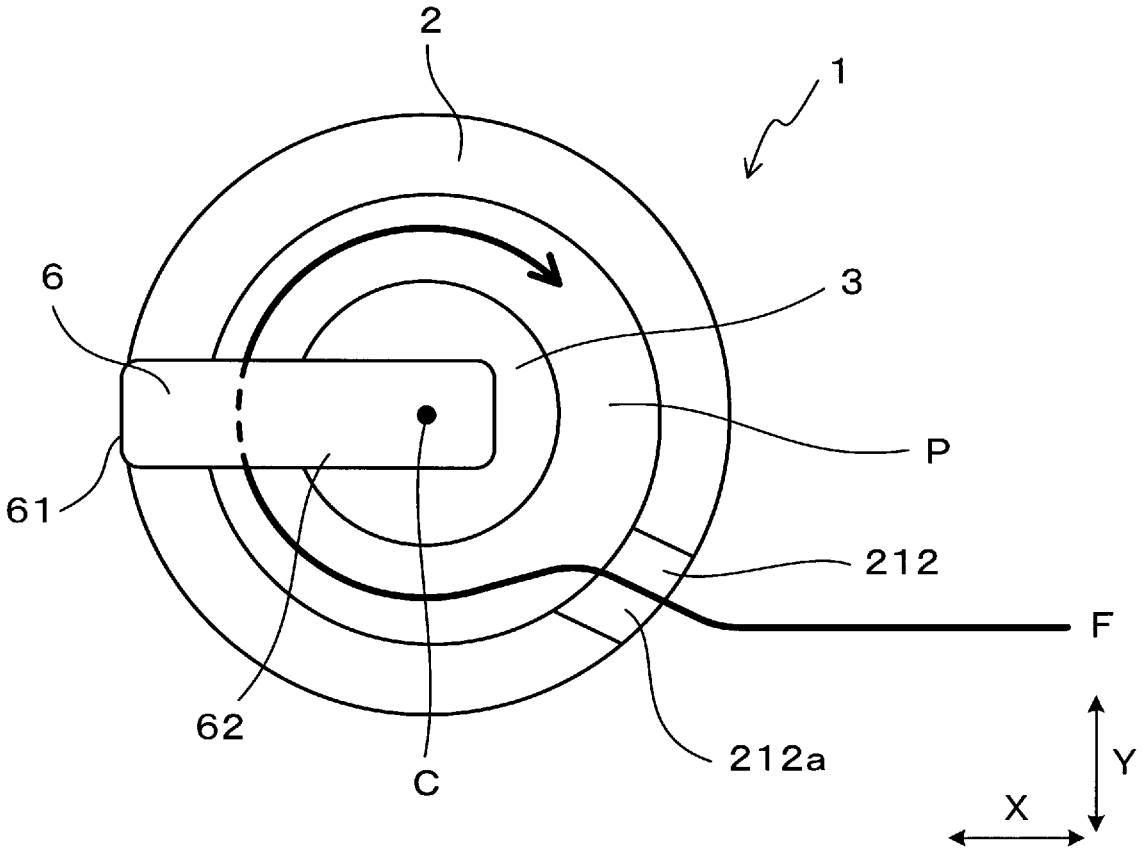
FIG. 18 is a schematic view showing the distal end side of the spark plug according to the third exemplary embodiment on a cross section of the spark plug orthogonal to the plug axial direction, and explaining a flow direction of the fuel mixture gas in the pocket formed in the spark plug.

A description will be given of the spark plug 1 according to a third exemplary embodiment of the present disclosure with reference to FIG. 16 to FIG. 18.

Figure 16:
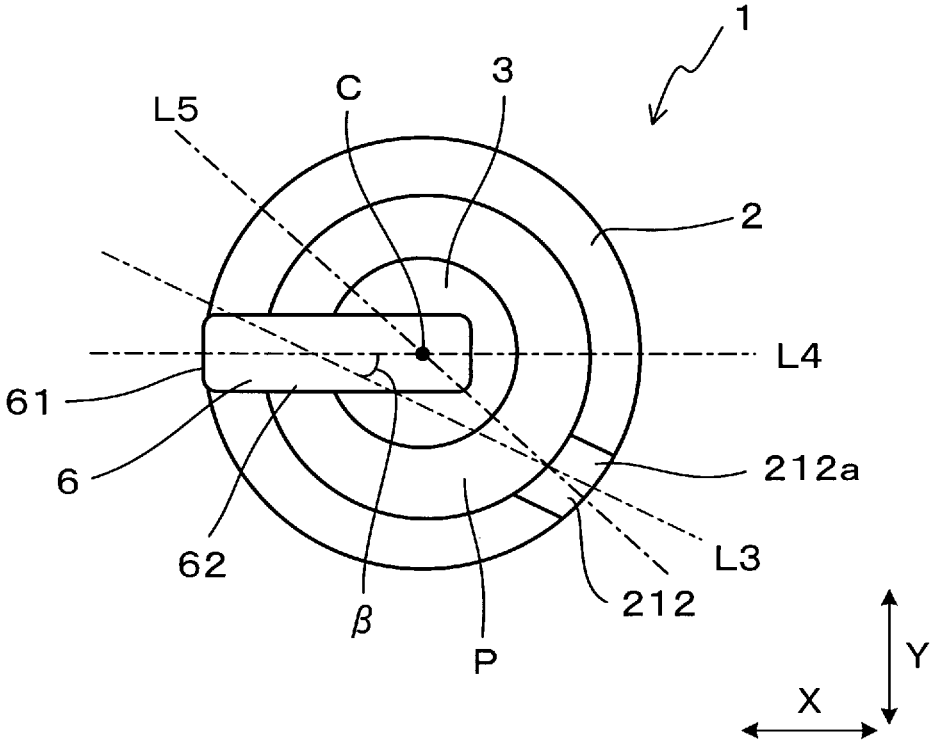
FIG. 16 is a view showing the distal end side of the spark plug according to the third exemplary embodiment on a cross section of the spark plug orthogonal to the plug axial direction thereof.

FIG. 16 is a view showing the distal end side of the spark plug 1 according to the third exemplary embodiment, on a cross section of the spark plug 1 orthogonal to the plug axial direction thereof. FIG. 17 is a view showing a cross section of the spark plug 1 mounted on the internal combustion engine. FIG. 17 explains a flow direction of fuel mixture gas in the pocket P in the spark plug 1. FIG. 18 is a schematic view showing the distal end side of the spark plug 1 according to the third exemplary embodiment. That is, FIG. 18 explains the flow direction of the fuel mixture gas in the pocket P formed in the spark plug 1.

The spark plug 1 according to the third exemplary embodiment has the channel part 212, and the formation direction of which is different from that of the spark plug according to the first exemplary embodiment.

On a cross section of the spark plug 1, orthogonal to the plug axial direction Z, according to the third exemplary embodiment shown in FIG. 16, a channel formation direction L3 of the channel part 212 does not pass through the plug central axis C, and is oblique relative to the plug central axis C a straight line L5 designated by the dotted line shown in FIG. 16.

Further, the channel formation direction L3 of the channel part 212 is oblique relative to the straight line L5, and also oblique relative to the arrangement direction L4 of the rod-shaped part 61 of the ground electrode 6, passing through the plug central axis C, in the direction X shown in FIG. 16. That is, the channel formation direction L3 is oblique relative to all straight lines (which include the straight line L5) passing each components of the channel part 212 and the plug central axis C. Similar to the first exemplary embodiment, the channel formation direction L3 is parallel with the channel side surfaces 212*b* formed at both edges of the channel bottom 212*a* of the channel part 212 in a direction orthogonal to the plug axial direction Z. As shown in FIG. 16, an angle β formed between the channel formation direction L3 and the arrangement direction L4 of the rod-shaped part 61 is less than 45°.

Other components of the spark plug according to the third exemplary embodiment are the same as those of the second exemplary embodiment.

On a cross section of the spark plug 1 spark plug according to the third exemplary embodiment shown in FIG. 16, the channel formation direction L3 designated by the dash-dotted line is oblique relative to the straight line L5 designated by the dotted line. This straight line connects the channel part 212 with the plug central axis C. As shown in FIG. 17 and FIG. 18, the flow F of the fuel mixture gas introduced into the inside of the pocket P through the channel bottom 212*a* of the channel part 212 is passing in spiral toward the depth of the pocket P. That is, the flow of the introduced fuel mixture gas flows toward the depth (or the proximal end side) of the spark plug. That is, a spiral flow of the fuel mixture gas occurs in the pocket P. This spiral flow of the fuel mixture gas makes it possible to discharge the fuel mixture gas from the pocket P. The generation of this spiral flow makes it possible to reduce an inside temperature of the pocket P, and to therefore prevent a pre-ignition phenomenon from occurring.

The spark plug 1 according to the third exemplary embodiment has the same behavior and effects of the spark plug according to the second exemplary embodiment.

Fourth Exemplary Embodiment

A description will be given of the spark plug 1 according to a fourth exemplary embodiment of the present disclosure with reference to FIG. 19 on a cross section of the spark plug orthogonal to the plug axial direction thereof. The spark plug 1 according to the fourth exemplary embodiment has the channel part formed along the direction X.

Figure 19:
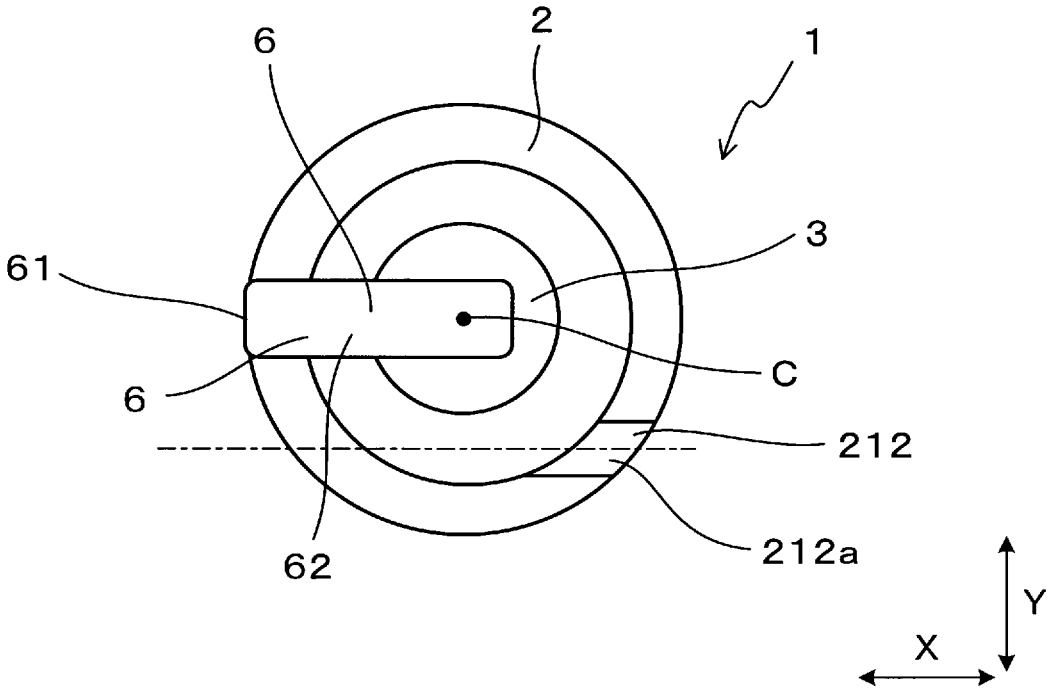
FIG. 19 is a view showing a distal end side of a spark plug according to a fourth exemplary embodiment on a cross section of the spark plug orthogonal to the plug axial direction thereof.

FIG. 19 is a view showing the distal end side of the spark plug according to the fourth exemplary embodiment. As shown in FIG. 19, the spark plug 1 has the channel part 212 formed parallel with the direction X which is orthogonal to the direction Y and the plug axial direction Z. The channel part 212 is formed in a channel formation direction designated by the dash-dotted line shown in FIG. 19. The channel formation direction of the channel part 212 does not pass through the plug central axis C In the structure of the spark plug 1 according to the fourth exemplary embodiment, the channel part 212 is formed along the direction X in the housing 2 so that the formation direction of the channel part 212 does not cross with the insulator 3 arranged in the plug axial direction Z, where the direction X is orthogonal to the direction Y and the plug axial direction Z.

Other components of the spark plug according to the fourth exemplary embodiment are the same as those of the third exemplary embodiment.

The spark plug 1 according to the fourth exemplary embodiment has the same behavior and effects of the spark plug according to the third exemplary embodiment.

In the structure of the spark plug according to the first to fourth exemplary embodiments, the channel part 212 has the channel bottom 212*a* and the pair of channel side surfaces 212*b*, and the channel bottom 212*a* has a plane shape crossing the plug axial direction Z. However, the concept of the present disclosure does not limit this structure of the channel bottom 212*a*. For example, it is acceptable for the channel bottom 212*a* to have a curved shape curved inward toward the proximal end side of the housing 2.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug having a central axis and an axial direction, the spark plug comprising:

a housing having a cylindrical shape around a circumferential direction of the spark plug, a distal end and a proximal end;

an insulator accommodated on an inside of the housing, and a channel part which is a recessed portion locally formed at a distal end part of the housing, in the circumferential direction, the channel part being open to an inside and outside of the housing, providing communication between the inside and the outside of the housing, wherein the channel part comprises;

a channel bottom formed obliquely inwards towards the proximal end of the housing, relative to the plug axial direction, and a pair of side surfaces which are formed on both edges of the channel bottom, parallel with the radial direction, the channel bottom of the channel part being positioned closer to the proximal end of the housing than the distal end part of the housing is.

2. The spark plug according to claim 1, wherein the channel part has a width W within a range of 1.2 mm≤W≤7.3 mm.

3. The spark plug according to claim 1, wherein the channel part has a depth D within a range of 0 mm≤D≤2.4 mm at an outer peripheral edge thereof.

4. The spark plug according to claim 2, wherein the channel part has a depth D within a range of 0 mm≤D≤2.4 mm at an outer peripheral edge thereof.

5. The spark plug according to claim 1, wherein the channel bottom of the channel part is formed in a plane shape, and an angle θ formed between the channel bottom and a virtual plane orthogonal to the plug axial direction Z is within a range of 37°≤θ≤58°.

6. The spark plug according to claim 2, wherein the channel bottom of the channel part is formed in a plane shape, and an angle θ formed between the channel bottom and a virtual plane orthogonal to the plug axial direction Z is within a range of 37°≤θ≤58°.

7. The spark plug according to claim 1, wherein the channel part is formed at the distal end of the housing along the radial direction of the spark plug, at a cross section of the distal end and oblique with the central axis of the spark plug.

8. The spark plug according to claim 2, wherein the channel part is formed at the distal end of the housing along the radial direction of the spark plug, at a cross section of the distal end and oblique with the central axis of the spark plug.

9. The spark plug according to claim 1, further comprising:

a central electrode accommodated inside of the insulator, the distal end of the central electrode projecting from the insulator; and a ground electrode connected to the housing, the ground electrode comprising a rod-shaped part and an extension part, the rod shaped part projecting from the housing toward the distal end of the spark plug and the extension part being connected to the rod shaped part and configured to extend inwardly in the radial direction, towards an inner circumferential part of the housing, and a discharge gap being formed between the central electrode and the extension part of the ground electrode, wherein the channel part is formed in the housing at a location which opposes the rod shaped part in a parallel direction with the central axis.

10. The spark plug according to claim 2, further comprising:

a central electrode accommodated inside of the insulator, the distal end of the central electrode projecting from the insulator; and a ground electrode connected to the housing, the ground electrode comprising a rod-shaped part and an extension part, the rod shaped part projecting from the housing toward the distal end of the spark plug and the extension part being connected to the rod shaped part and configured to extend inwardly in the radial direction, towards an inner circumferential part of the housing, and a discharge gap being formed between the central electrode and the extension part of the ground electrode, wherein the channel part is formed in the housing at a location which opposes the rod shaped part in a parallel direction with the central axis.

* * * * *